United States Patent [19]

Dettmers et al.

[11] 4,440,522

[45] Apr. 3, 1984

[54] HYDRAULIC CONTROL ARRANGEMENT FOR A ROOF SUPPORT UNIT OF A MINERAL MINING INSTALLATION

[75] Inventors: Michael Dettmers, Kamen; Walter Weirich, Dortmund, both of Fed. Rep. of Germany

[73] Assignee: Gewerkschaft Eisenhutte Westfalia, Lunen, Fed. Rep. of Germany

[21] Appl. No.: 217,968

[22] Filed: Dec. 19, 1980

[30] Foreign Application Priority Data

Jan. 26, 1980 [DE] Fed. Rep. of Germany ..... 3002818

[51] Int. Cl.[3] ..... E21D 15/14; E21D 23/00; E21D 23/16; F15B 11/20

[52] U.S. Cl. ..... 405/293; 405/299; 405/302; 91/170 MP; 91/520

[58] Field of Search ..... 405/299-302, 405/293; 91/170 MP, 520

[56] References Cited

U.S. PATENT DOCUMENTS 2,475,298 7/1949 Sloane ..... 91/520 X
3,436,922 4/1969 Irresberger et al. ..... 405/299 X
3,530,490 9/1970 Ward et al. ..... 91/170 MP
3,795,177 3/1974 Cryder et al. ..... 91/520 X
3,990,594 11/1976 Olson et al. ..... 91/520 X

*Primary Examiner*—David H. Corbin
*Assistant Examiner*—Nancy J. Pistel
*Attorney, Agent, or Firm*—Thompson, Birch et al.

[57] ABSTRACT

A roof support unit for a longwall mineral mining installation has a roof shield supported above a floor sill. A first hydraulic ram is provided for advancing the roof support unit. The roof shield is provided with a forward extension which is advanceable by means of a second hydraulic advance ram. A hydraulic control arrangement, which includes the two hydraulic advance rams is provided for controlling the advance of the roof shield extension in dependence upon the working stroke of the first hydraulic advance ram. The control arrangement is such that the amount of hydraulic fluid supplied to one of the pressure chambers of the second hydraulic advance ram is dependent upon the amount of hydraulic fluid expelled from one of the pressure chambers of the first hydraulic advance ram during the working stroke of the first hydraulic advance ram.

17 Claims, 2 Drawing Figures

HYDRAULIC CONTROL ARRANGEMENT FOR A ROOF SUPPORT UNIT OF A MINERAL MINING INSTALLATION

BACKGROUND TO THE INVENTION

This invention relates to a hydraulic control arrangement for a roof support unit of a longwall mineral mining installation having a conveyor and a plurality of roof support units positioned side-by-side along the goaf side of the conveyor, and in particular to control means for controlling the advance of shield extensions of the roof shields of the roof support units.

The shield extensions of such an installation are advanced towards the face being won by hydraulic rams associated with the corresponding roof shields. The shield extensions support the roof in the mineral mining working in the critical region adjacent to the face. It is important, therefore, to advance the shield extensions as soon as possible after the conveyor has been advanced following a cutting run of the plough (or other winning machine) along the face side of the conveyor. Known systems for advancing the shield extensions incorporate either manual control means or automatic control means.

In one known automatic control system, special sensors are provided on the shield extensions, these sensors serving to sense the position of the face, and to control the advance of the shield extensions in dependence upon their distance from the face. Such a system is relatively expensive. Moreover, this type of system is not very reliable, since the face does not constitute a well-defined limiting surface.

The aim of the invention is to provide a hydraulic control arrangement for a roof support unit which does not suffer from these disadvantages.

SUMMARY OF THE INVENTION

The present invention provides a hydraulic control arrangement for a roof support unit of a mineral mining installation, the hydraulic control arrangement comprising a first hydraulic ram and a second hydraulic ram, each of the hydraulic rams having a pair of pressure chambers positioned on opposite sides of a respective reciprocable piston, wherein the control arrangement is such that the amount of hydraulic fluid supplied to one of the pressure chambers of the second hydraulic ram is dependent upon the amount of hydraulic fluid expelled from one of the pressure chambers of the first hydraulic ram during the working stroke of the first hydraulic ram.

This hydraulic control arrangement permits the working stroke of the second hydraulic ram (say the hydraulic ram associated with the roof shield extension of a roof support unit) to be controlled in dependence upon the amount of hydraulic fluid forced out of said one pressure chamber of the first hydraulic ram (say the advance ram of the roof support unit). In particular, the working stroke of the second hydraulic ram can be arranged to be substantially equal to the working stroke of the first hydraulic ram. This can be done without the need to provide trouble-prone sensor systems or other expensive control equipment. Indeed, it is possible to connect said one pressure chamber of the second hydraulic ram directly to said one pressure chamber of the first hydraulic ram. Preferably, however, said one pressure chamber of the second hydraulic ram is connected to said one pressure chamber of the first hydraulic ram via a metering device. This use of a metering device is particularly advantageous where major resistance to the advance of the second hydraulic ram may occur (for example, where the advance of a roof shield extension associated with the second hydraulic ram is subject to large resistive forces from the roof of a mine working).

The control arrangement may further comprise a third hydraulic ram having a pair of pressure chambers positioned on opposite sides of a reciprocable piston, wherein the amount of hydraulic fluid supplied to one of the pressure chambers of the third hydraulic ram is dependent upon the amount of hydraulic fluid expelled from said one pressure chamber of the first hydraulic ram during the working stroke of the first hydraulic ram. The third hydraulic ram can be used, for example, to control the advance of an auxiliary roof shield for screening an access area to a roof support unit.

Preferably, the metering device is a metering ram having a cylinder and a piston reciprocable within the cylinder, the metering ram having a metering chamber connected to said one pressure chamber of the second hydraulic ram and a pressure chamber connected to said one pressure chamber of the first hydraulic ram. In this case, each working stroke of the first hydraulic ram results in a predetermined amount of hydraulic fluid being forced into the metering chamber, this predetermined amount of hydraulic fluid being conveyed, during the next metering stroke, into said one pressure chamber of the second hydraulic ram.

Advantageously, said one pressure chamber of the first hydraulic ram is connected to the pressure chamber of the metering ram by a hydraulic line incorporating a non-return valve.

Where the arrangement has a third hydraulic ram, said one pressure chamber of the third hydraulic ram may be connected to said one pressure chamber of the first hydraulic ram via the metering ram. In this case, the metering ram may have a second metering chamber connected to said one pressure chamber of the third hydraulic ram.

Conveniently, the or each metering chamber of the metering ram is connected to a hydraulic return line via a respective hydraulic line incorporating a non-return valve.

Preferably, the metering ram has a high-pressure chamber which is positioned at the opposite side of the piston of the metering ram to the pressure chamber and to the or each metering chamber, the high-pressure chamber being connected to a hydraulic high-pressure line via a first control valve. In this case, the working stroke of the metering ram is directly dependent upon the amount of hydraulic fluid forced out of said one pressure chamber of the first hydraulic ram during the working stroke of the first hydraulic ram. Thus, the amount of hydraulic fluid forced out of the or each metering chamber during the working stroke of the metering ram is proportional to the amount of hydraulic fluid forced out of said one pressure chamber of the first hydraulic ram during the working stroke of the first hydraulic ram. During the working stroke of the metering ram, the amount of hydrulic fluid initially in the or each metering chamber is forced into the associated second or third hydraulic ram, so that the latter execute working strokes proportional to that of the first hydraulic ram. Thus, this control arrangement is successful in achieving satisfactory advance of the roof shield extension of a roof support unit as a follow-up to the advance of a conveyor associated with that roof support unit. Consequently, the roof of a mine working can be reliably supported in the critical zone adjacent to its face.

Advantageously, the piston of the metering ram is a stepped piston which defines at least one annular chamber within the cylinder of the metering ram, the or each metering chamber being constituted by the or one of the annular chambers. Preferably, the stepped piston defines at least two annular chambers within the cylinder of the metering ram, one of said annular chambers constituting the pressure chamber of the metering ram, and the or each of the other annular chambers constituting a respective metering chamber. In this case, the pressure chamber of the metering ram may be connected to the hydraulic high-pressure line via a hydraulic line incorporating a non-return valve. This prevents the metering ram from acting as a pressure booster.

Preferably, the two pressure chamber of the first hydraulic ram are connected to the hydraulic high-pressure line and to the hydraulic return line via a second control valve, the second control valve being such that said one pressure chamber of the first hydraulic ram can be isolated from the hydraulic return line.

It is also possible for the pressure chamber of the metering ram to constitute a metering chamber.

Advantageously, the metering ram is such that the working stroke of the second hydraulic ram is slightly greater than the working stroke of the first hydraulic ram.

The invention also provides a roof support unit for a mineral mining installation, the roof support unit comprising a floor sill, a roof shield supported above the floor sill, a roof shield extension associated with the roof shield, and a hydraulic control arrangement as defined above, the first hydraulic ram of the hydraulic control arrangement being arranged to advance the roof support unit, and the second hydraulic ram of the hydraulic control arrangement being arranged to advance the roof shield extension with respect to the roof shield.

The invention further provides a mineral mining installation comprising a conveyor, and a plurality of roof support units as defined above.

Advantageously, the conveyor is constituted by a plurality of conveyor sections, each conveyor section being connected to a respective roof support unit by the first hydraulic ram of that roof support unit. Preferably, a single, first control valve is provided for a plurality of metering rams.

The first control valve(s) may be actuated by hand, or by remote control from a central station. Preferably, however, the or each first control valve is actuatable automatically in dependence upon the movement of a mineral winning machine along the conveyor.

BRIEF DESCRIPTION OF THE DRAWINGS

A mineral mining installation incorporating a hydraulic control arrangement constructed in accordance with the invention will now be described, by way of examle, with reference to the accompanying drawings, in which.

DESCRIPTION OF PREFERRED EMBODIMENT

Figure 1:
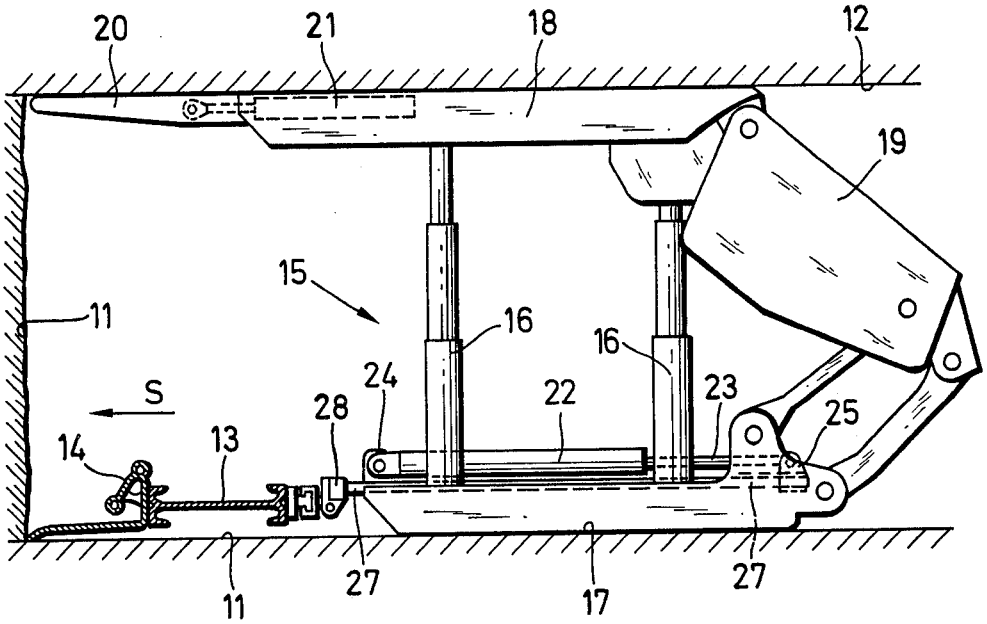
FIG. 1 is a part-sectional side elevation of the mineral mining installation, and shows a longwall conveyor and a mine roof support unit positioned at the goaf side of the conveyor.

Referring to the drawings, FIG. 1 shows a longwall mineral mining working having a face 10, a floor 11 and a roof 12. A scraper-chain conveyor 13 extends along the working adjacent to the face 10. A plough guide 14 is provided at the face side of the conveyor, a plough (not shown) being drivable to and fro along the guide for winning mineral material (such as coal) from the face 10.

A mine roof support assembly is positioned at the goaf side of the conveyor 13, the assembly being constituted by a plurality of mine roof support units 15 (only one of which can be seen in FIG. 1) positioned side-by-side. Each roof support unit 15 has four hydraulic props 16 mounted on a floor sill 17, the props carrying a roof shield 18 for supporting the roof 12. The props 16 are arranged at the corners of a rectangle, and each of the props is joined to the roof shield 18 by means of a ball joint (not shown). The floor sill 17 may be made in one piece, or it may be of multi-part construction. A goaf shield 19 is pivotally attached to the rear (goaf) ends of the roof shield 18 and the floor sill 17. The roof shield 18 is provided with a forward extension 20, which slidingly engages the roof shield, and which can be advanced towards the face 10 by means of a hydraulic ram 21.

As the face 10 is won, the conveyor 13 is advanced to follow up the advance of the face. The conveyor 13 is advanced by means of advance rams 22 assocated with the roof support units 15. Each advance ram 22 has a cylinder which is pivotally attached, at 24, to a bracket fixed to the face-side end of the floor sill 17 of the associated roof support unit 15. The piston rod 23 of that advance ram 22 is pivotally connected to a cross-piece 25 attached to the rear (goaf) end of a guide linkage 27, constituted by a pair of parallel, resilient, steel rods. The front (face) ends of the rods 27 are connected by a head 28 which is attached to the conveyor 13. The arrangement is such that retraction of the advance rams 22 causes the conveyor 13 to be advanced, in the direction of the arrow S, by the guide rods 27, the roof support units 15 forming an abutment for this advance of the conveyor. Similarly, by extending the advance rams 22, the roof support units 15 are advanced in a follow-up sequence, the conveyor 13 acting as an abutment for this advance movement. As is usual, the conveyor 13 is advanced several times before it is necessary for the roof support units to be advanced. This is because the cutting depth of the plough is considerably smaller than the length of the working stroke of the advance rams 22.

The roof 12 of the working must be effectively supported at all times, particularly in the region of the face 10. For this purpose, the shield extensions 20 are arranged to be advanced automatically towards the face 10 as the conveyor 13 is advanced by the advance rams 22. Usually, the conveyor 13 is advanced in sections, each conveyor section being advanced after the plough has left that section on its winning run.

Figure 2:
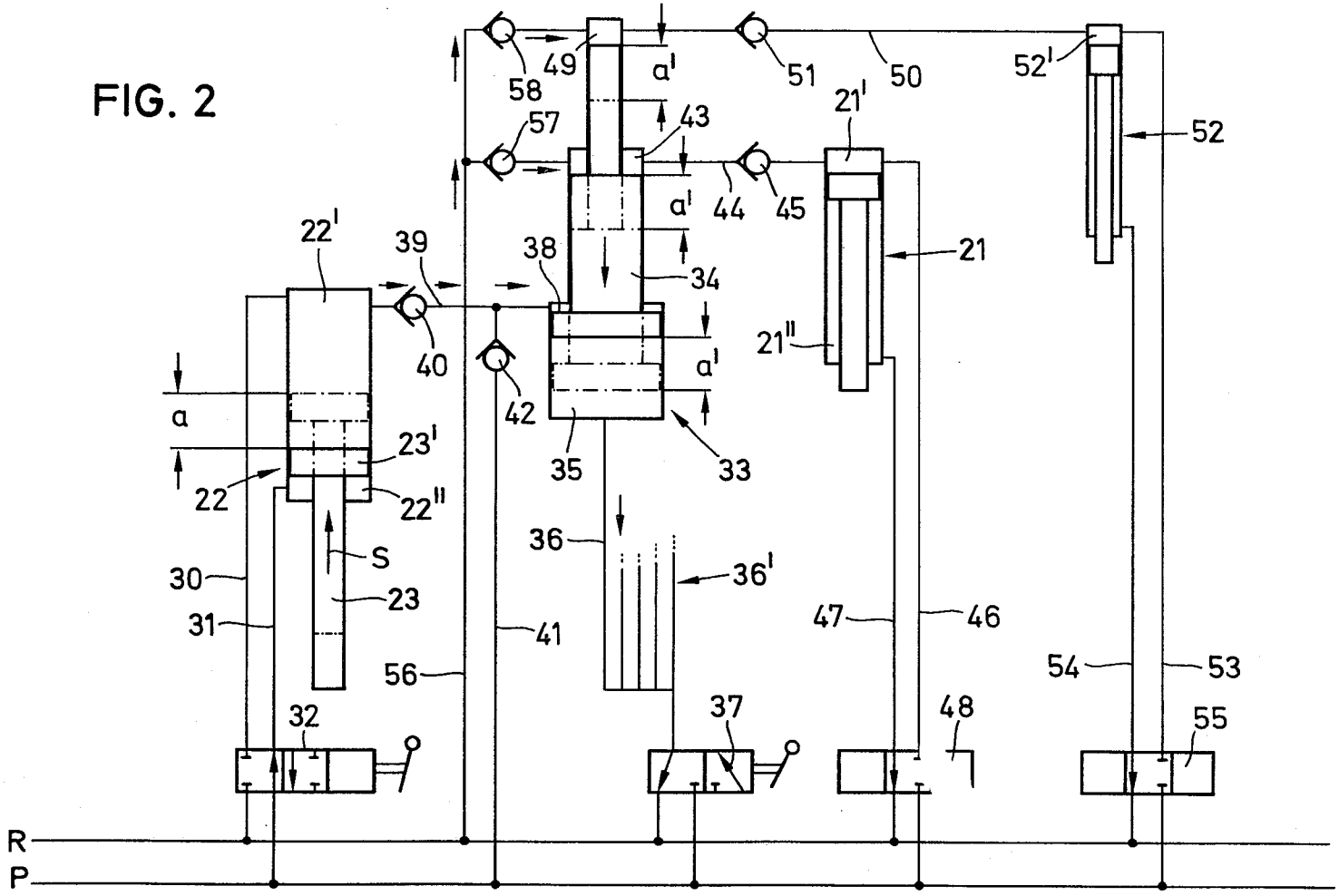
FIG. 2 is a hydraulic circuit diagram of the installation shown in FIG. 1.

FIG. 2 shows a hydraulic circuit for controlling the double-acting hydraulic ram 21 associated with the shield extension 20 of one roof support unit 15, the ram 21 being advanced a distance which depends upon the distance of advance of the ram 22 of that roof support unit. Each of the roof support units 15 has a similar hydraulic control circuit. The ram 22 has two chambers 22' and 22'', pressurisation of the chamber 22' serving to extend the ram, and pressurisation of the chamber 22" serving to retract the ram. The chamber 22' (which is of circular cross-section) is connected, via a hydraulic line 30, to an outlet port of a manually-operated control valve 32. Similarly, the chamber 22" (which is of annular cross-section) is connected, via a hydraulic line 31, to a second outlet port of the control valve 32. The inlet ports of the control valve 32 are connected to hydraulic high-pressure and return lines P and R respectively, which extend along the longwall working, and serve the control circuits of all the roof support units 15.

A metering ram 33 is associated with the ram 22, the metering ram having a stepped piston 34 arranged within a stepped cylinder. The metering ram 33 has several working chambers, the chamber having the largest cross-sectional area being a cylindrical, high-pressure chamber 35. The chamber 35 is connected, via a line 36, to the outlet of a control valve 37. The inlet side of the control valve 37 is connected to the high-pressure line P and the return line R.

The metering ram 33 also has two annular chambers 38 and 43, the chamber 38 having a larger cross-sectional area than the chamber 43. The chamber 38 is connected, via a line 39, to the chamber 22' of the ram 22. The line 39 incorporates a non-return valve 40, which prevents hydraulic fluid flowing from the chamber 38 to the chamber 2'; but which permits the flow of hydraulic fluid in the opposite direction, when the piston rod 23 of the ram 22 is retracted. The line 39 is also connected, via a line 41, to the high-pressure line P, a non-return valve 42 being incorporated in the line 41. The chamber 43 constitutes a metering chamber, and is connected, via a line 44, to the chamber 21' of the ram 21. The line 44 also incorporates a non-return valve 45. The two chambers 21' and 21" of the ram 21 are connected, via lines 46 and 47 respectively, to the outputs of a control valve 48. The inlet side of the control valve 48 is connected to the high-pressure line P and the return line R.

The metering ram 33 has a piston 34 which is doubly-stepped. Consequently, the ram 33 has a second, cylindrical metering chamber 49, this chamber having a smaller cross-sectional area than the metering chamber 43. The chamber 49 is connected, via a line 50, to a working chamber 52' of an auxiliary advance ram 52. The ram 52 could be used, for example, to control the advance of an auxiliary shield (not shown) which is used to screen an access area. The line 50 incorportes a non-return valve 51. The two working chambers of the ram 52 are connected, via lines 53 and 54, to the outputs of a control valve 55, whose inlet side is connected to the high-pressure line P and the return line R. If the ram 52 is not operational, the chamber 49 of the metering ram 33 is un-pressurised.

The two metering chambers 43 and 49 of the metering ram 33 are connected, via a supply line 56, to the return line R. Non-return valves 57 and 58 are connected in respective branch lines leading from the supply line 56 to the metering chambers 43 and 49.

The control circuit described above works in the following manner. In order to advance the conveyor 13 (and the plough guide 14) in the direction of the arrow S (see FIG. 1), that is to say towards the face 10, the control valve 32 is brought into the control position shown in FIG. 2. In this position, the chamber 22" of the advance ram 22 is connected to the high-pressure line P, and the chamber 22' is isolated from the return line R. Thus, the chamber 22" of the advance ram 22 is pressurised, so that the piston rod 23 is retracted, and the conveyor 13 is advanced by a distance a. The distance a of conveyor advance is arranged to be the same as cutting depth of the plough which moves to and fro along the plough guide 14. Usually, the cutting depth of a typical longwall plough lies in the range of from 60 millimeters to 140 millimeters. At the end of this advance movement, the piston rod of the advance ram 22 is in the position 23' shown in dash-dot lines in FIG. 2.

As the piston rod 23 is retracted, the hydraulic fluid in the chamber 22' is forced, via the line 39 and the non-return valve 40, into the chamber 38 of the metering ram 33. This results in the stepped piston 34 being retracted by a distance a', the stepped piston being in the position shown in dash-dot lines (see FIG. 2) at the end of this movement. The distance a' is dependent upon the distance a. In particular, if the cross-sectional area of the annular chamber 38 equals that of cylindrical chamber 22', a' equals a.

As the stepped piston 34 is retracted, the two metering chambers 43 and 49 of the metering ram 33 are each charged up with a predetermined amount of hydraulic fluid. This charging up is effected by drawing in hydraulic fluid from the return line P via the supply line 56 and the non-return valves 57 and 58. The amount of hydraulic fluid drawn into each of the metering chambers 43 and 49 is dependent upon the stroke a' of the stepped piston 34, and accordingly is proportional to the amount of hydraulic fluid expelled from the chamber 22' of the advance ram 22 during the working stroke a of that ram. Thus, the chamber 22' itself constitutes a metering chamber which, during each retraction stroke, forces a predetermined amount of hydraulic fluid into the chamber 38 of the metering ram 33.

After the conveyor 13 has been advanced, the control valve 37 associated with the metering ram 33 is changed over from the position shown in FIG. 2. This can be accomplished manually, automatically in dependence upon the movement of the plough along the face 10, or from a central control station. In this changed-over position, the high-pressure chamber 35 of the metering ram 33 is connected to the high-pressure line P. Consequently, the stepped piston 34 is extended (that is to say it moves from the position shown in dash-dot lines in FIG. 2 to the position shown in full lines). During this extension (metering) stroke, the amount of hydraulic fluid in the metering chamber 43 is forced, via the line 44 and the non-return valve 45, into the chamber 21' of the advance ram 21. At the same time, the amount of hydraulic fluid in the metering chamber 49 is forced, via the line 50 and the non-return valve 51, into the chamber 52' of the ram 52. Hence, the rams 21 and 52 are each extended by a predetermined distance (working stroke). By appropriate dimensioning of the piston cross-sections, it is possible for the working stokes of the rams 21 and 52 to be dependent upon the working stroke of the advance ram 22. In particular, the working stroke of the ram 21 may be made equal to that of the ram 22. In this case, the shield extension 20 will always be moved forward the same distance as that through which the conveyor 13 is advanced, thus ensuring reliable roof support immediately in front of the face 10. In some cases, however, it is advisable to make the working stroke of the ram 21 slightly greater than the maximum cutting depth of the plough (and hence the working stroke a of the ram 22). This ensures that the shield extension 20 is always advanced far enough to contact the face 10, thereby ensuring roof support right up to the face.

During the metering stroke of the metering ram 33, the hydraulic fluid in the chamber 38 (which was previously expelled from the chamber 22' of the advance ram 22) is forced, via the line 41 and the non-return valve 42, into the high-pressure line P. This connection between the chamber 38 and the high-pressure line P prevents the metering ram 33 from acting as a pressure booster. This is because the cross-sectional area of the annular metering chamber 43 plus the cross-sectional area of the metering chamber 49 equals the cross-sectional area of the high-pressure chamber 35 less the cross-sectional area of the chamber 38. However, it is possible to vary these cross-sectional areas if a pressure boost is required.

After the metering stroke has taken place, the control valve 37 is changed back to the position shown in FIG. 2. In this position, the high-pressure chamber 35 of the metering ram 33 is connected to the return line R. At the same time, the control valve 32 is switched over so that the chamber 22' is connected to the return line R, and the chamber 22'' is isolated. The control system is then ready for the next cycle to commence. It will be appreciated that, if required, the metering ram 33 can be by-passed, and the rams 21 and 52 can be extended (or retracted) by appropriate switching of the control valves 48 and 55.

It will be apparent that the control system described above could be modified in a number of ways. Thus, if the metering chamber 49 of the metering ram 33 is not required, a singly-stepped metering piston can be used in place of the doubly-stepped piston 34. It is also possible to provide a single, common control valve 37 for a plurality (or all) of the metering rams 33 in the longwall working. In this case the outlet side of the control valve 37 will have the same number of outlet ports as there are metering rams 33 to be controlled, each outlet port being connected to its metering ram via a respective line 36'. Thus, by switching over the common control valve 37, all the shield extensions 20 of the group will be advanced simultaneously.

In another modification, the chamber 38 of the metering ram 33 takes over the function of the metering chamber 43. In this case, the chamber 21' of the ram 21 is connected to the chamber 38, whilst an excess-pressure valve (not shown) is incorporated in the line connecting these two chambers. The excess-pressure valve blocks the inflow of hydraulic fluid to the chamber 21', during the advance of the conveyor 13, as long as the piston 34 of the metering ram 33 is carrying out its metering stroke. After the conveyor 13 has been advanced, the amount of hydraulic fluid in the chamber 38 is forced, by connecting the high-pressure chamber 35 to the high-pressure line P, into the chamber 21' of the ram 21 via the connecting line which is now open.

It will also be apparent that the advance ram 22 can be arranged so that the conveyor 13 (and the plough guide 14) are advanced when the advance ram 22 is extended.

Moreover, the metering ram 33 having a stepped piston 34 could be replaced by any other suitable metering device having a multiplicity of chambers.

We claim:

1. A hydraulic control arrangement for a roof support unit of a mineral mining installation, the hydraulic control arrangement comprising: a first hydraulic ram, a second hydraulic ram, a third hydraulic ram, and a metering ram, each of the first, second and third hydraulic rams having a pair of pressure chambers positioned on opposite sides of a respective reciprocable piston, the metering ram being hydraulically interposed between said first hydraulic ram and said second and third hydraulic rams in an arrangement such that the amount of hydraulic fluid supplied to one of the pressure chambers of each of the second and third hydraulic rams is dependent upon the amount of hydraulic fluid expelled from one of the pressure chambers of the first hydraulic ram during the working stroke of the first hydraulic ram, the metering ram having a reciprocable piston with first and second metering chambers and a working chamber on one side thereof, and a high pressure chamber on the opposite side thereof, said first and second metering chambers being connected respectively to the said one pressure chambers of the second and third hydraulic rams, said working chamber being connected to the said one pressure chamber of the first hydraulic ram, and said high-pressure chamber being connected to a hydraulic high-pressure line.

2. A control arrangement according to claim 1, wherein said one pressure chamber of the first hydraulic ram is connected to the working chamber of the metering ram by a hydraulic line incorporating a non-return valve.

3. A control arrangement according to claim 1, wherein the metering chambers of the metering ram are connected to a hydraulic return line via respective hydraulic lines incorporating non-return valves.

4. A control arrangement according to claim 1, wherein each metering chamber of the metering ram is connected to a hydraulic return line via a respective hydraulic line incorporating a non-return valve.

5. A control arrangement according to claim 1, wherein the high-pressure chamber is connected to a hydraulic high-pressure line via a first control valve.

6. A control arrangement according to claim 5, wherein the piston of the metering ram is a stepped piston which defines two annular chambers within the cylinder of the metering ram, one of the annular chambers being said first metering chamber, the other of the annular chambers being the working chamber of the metering ram.

7. A control arrangement according to claim 1, wherein the piston of the metering ram is a stepped piston which defines three annular chambers within the cylinder of the metering ram, one of the annular chambers being the working chamber of the metering ram, and the other two annular chambers being said metering chambers.

8. A control arrangement according to claim 6, wherein the working chamber of the metering ram is connected to the hydraulic high-pressure line via a hydraulic line incorporating a non-return valve.

9. A control arrangement according to claim 5, wherein the two pressure chambers of the first hydraulic ram are connected to the hydraulic high-pressure line and to the hydraulic return line via a second control valve, the second control valve being such that said one pressure chamber of the first hydraulic ram can be isolated from the hydraulic return line.

10. A control arrangement according to claim 1, wherein the working chamber of the metering ram also constitutes a metering chamber.

11. A control arrangement according to claim 1, wherein the metering ram is such that the working stroke of the second hydraulic ram is slightly greater than the working stroke of the first hydraulic ram.

12. A roof support unit for a mineral mining installation, the roof support unit comprising a floor sill, a roof shield supported above the floor sill, a roof shield extension associated with the roof shield, and a hydraulic control arrangement comprising a first hydraulic ram, a second hydraulic ram, and a metering ram, each of the first and second hydraulic rams having a pair of pressure chambers positioned on opposite sides of the respective reciprocable piston, and the metering ram having a cylinder and a piston reciprocal within the cylinder, wherein the metering ram is such that the amount of hydraulic fluid supplied to one of the pressure chambers of the second hydraulic ram is dependent upon the amount of hydraulic fluid expelled from one of the pressure chambers of the first hydraulic ram during the working stroke of the first hydraulic ram, the first hydraulic ram of the hydraulic control arrangement being arranged to advance the roof support unit, and the second hydraulic ram of the hydraulic control arrangement being arranged to advance the roof shield extension with respect to the roof shield, the metering ram having a metering chamber connected to said one pressure chamber of the second hydraulic ram, a working chamber connected to said one pressure chamber of the first hydraulic ram, and a high-pressure chamber positioned at the opposite side of the piston of the metering ram to the working chamber and to the metering chamber, the high-pressure chamber being connected to a hydraulic high-pressure line.

13. A mineral mining installation comprising a conveyor, and a plurality of roof support units positioned side-by-side along the goaf side of the conveyor, each of the roof support units comprising a floor sill, a roof shield supported above the floor sill, a roof shield extension associated with the roof shield, and a hydraulic control arrangement comprising a first hydraulic ram, a second hydraulic ram, and a metering ram, each of the first and second hydraulic rams having a pair of pressure chambers positioned on opposite sides of a respective reciprocable piston and the metering ram having a cylinder and a piston reciprocal within the cylinder, wherein the metering ram is such that the amount of hydraulic fluid supplied to one of the pressure chambers of the second hydraulic ram is dependent upon the amount of hydraulic fluid expelled from one of the pressure chambers of the first hydraulic ram during the working stroke of the first hydraulic ram, the first hydraulic ram of the hydraulic control arrangement being arranged to advance the roof support unit, and the second hydraulic ram of the hydraulic control arrangement being arranged to advance the roof shield extension with respect to the roof shield, the metering ram having a metering chamber connected to said one pressure chamber of the second hydraulic ram, a working chamber connected to said one pressure chamber of the first hydraulic ram, and a high-pressure chamber positioned at the opposite side of the piston of the metering ram to the working chamber and to the metering chamber, the high-pressure chamber being connected to a hydraulic high-pressure line.

14. A mineral mining installation according to claim 13, wherein said one pressure chamber of the second hydraulic ram of each hydraulic control arrangement is connected to said one pressure chamber of the first hydraulic ram of that hydraulic control arrangement via a metering ram having a cylinder and a piston reciprocable within the cylinder, the metering ram having a metering chamber connected to said one pressure chamber of the second hydraulic ram of that hydraulic control arrangement and a pressure chamber connected to said one pressure chamber of the first hydraulic ram of that hydraulic control arrangement, and wherein the metering ram of each hydraulic control arrangement has a high-pressure chamber which is positioned on the opposite side of the piston of that metering ram to the pressure chamber and to the metering chamber of that metering ram, said high-pressure chamber being connected to a hydraulic high-pressure line via a control valve.

15. A mineral mining installation according to claim 14, wherein a single, control valve is provided for a plurality of metering rams.

16. A mineral mining installation according to claim 14, wherein each control valve is actuatable automatically in dependence upon the movement of a mineral winning machine along the conveyor.

17. A mineral mining installation according to claim 15, wherein each control valve is actuatable automatically in dependence upon the movement of a mineral winning machine along the conveyor.

* * * * *